US005408057A

United States Patent [19]

Hayes

[11] Patent Number: 5,408,057

[45] Date of Patent: Apr. 18, 1995

[54] MULTIPLE ELECTRICAL SWITCH CONTROL DEVICE INCLUDING BRACKET WITH SEVERABLE PLUNGERS AND METHOD

[75] Inventor: William S. Hayes, Holland, Mich.

[73] Assignee: RobertShaw Controls Company, Richmond, Va.

[21] Appl. No.: 96,758

[22] Filed: Jul. 23, 1993

[51] Int. Cl.[6] ..... H01H 9/00; H01H 11/00; H01H 13/70

[52] U.S. Cl. ..... 200/5 A; 29/622

[58] Field of Search ..... 200/5 R, 5 A, 314, 512, 200/514–517, 329–345, 302.1–302.3, 61.58 R–61.93; 29/622; 206/223

[56] References Cited

U.S. PATENT DOCUMENTS 3,978,297 8/1976 Lynn et al. ..... 200/5 A
4,059,737 11/1977 Gergaud ..... 200/5 A
4,145,584 3/1979 Otterlei ..... 200/5 A
4,625,084 11/1986 Fowler et al. ..... 200/11 DA
4,728,755 3/1988 Fowler et al. ..... 200/11 DA

*Primary Examiner*—J. R. Scott
*Attorney, Agent, or Firm*—Candor, Candor & Tassone

[57] ABSTRACT

A control device and method of making the same are provided, the control device having a plurality of electrical switch units carried by a support, a bracket structure carried by the support and having a plurality openings passing therethrough and being respectively aligned with the switch units, a cover carried by the bracket structure and having a plurality of finger movable areas respectively covering the openings, and a plurality of plungers disposed in the openings, the plungers each having been initially integral and one-piece with the bracket structure and having been separated therefrom to freely float relative to the bracket structure between its respective movable area of the cover and its respective switch unit.

22 Claims, 5 Drawing Sheets

MULTIPLE ELECTRICAL SWITCH CONTROL DEVICE INCLUDING BRACKET WITH SEVERABLE PLUNGERS AND METHOD

BACKGROUND OF THE INVENTION

1. Field of the Invention

This invention relates to a new control device, such as a control device for controlling the operation of a cooking apparatus or the operation of any other suitable apparatus, and to a new method of making such a control device.

2. Prior Art Statement

It is known to provide a control device comprising a support means, a plurality of electrical switch means carried by the support means and each having a movable actuator means, a bracket means carried by the support means and having a plurality of opening means passing therethrough and being respectively aligned with the actuator means, a cover means carried by the bracket means and having a plurality of finger movable areas respectively covering the opening means, and a plurality of plunger means having first parts thereof respectively disposed in the opening means and having second parts thereof being engagable with the actuator means.

SUMMARY OF THE INVENTION

It is one of the features of this invention to provide a new control device which has unique means for operating a plurality of switch means thereof.

In particular, it was found according to the teachings of this invention that a bracket means of the control device that is disposed over a plurality of electrical switch means carried by a support means of the control device can be initially formed with a plurality of plunger means that are integral and one-piece therewith and that can be subsequently completely separated therefrom so as to operate between a cover means subsequently secured to the bracket means and the switch means while being guided in the movement thereof by opening means formed through the bracket means and in which the plunger means were initially formed.

For example, one embodiment of this invention comprises a control device comprising a support means, a plurality of electrical switch means carried by the support means and each having a movable actuator means, a bracket means carried by the support means and having a plurality of opening means passing therethrough and being respectively aligned with the actuator means, a cover means carried by the bracket means and having a plurality of finger movable areas respectively covering the opening means, and a plurality of plunger means having first parts thereof respectively disposed in the opening means and having second parts thereof being engagable with the actuator means, each plunger means having been initially integral and one-piece with the bracket means and having been separated therefrom to freely float relative to the bracket means between its respective movable area of the cover means and its respective actuator means whereby each movable area of the cover means is selectively finger depressed toward the support means to move its respective plunger means and thus its respective actuator means to change the operating condition of its respective switch means.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompany drawings forming a part thereof and wherein:

DESCRIPTION OF THE PREFERRED EMBODIMENT

Figure 1:
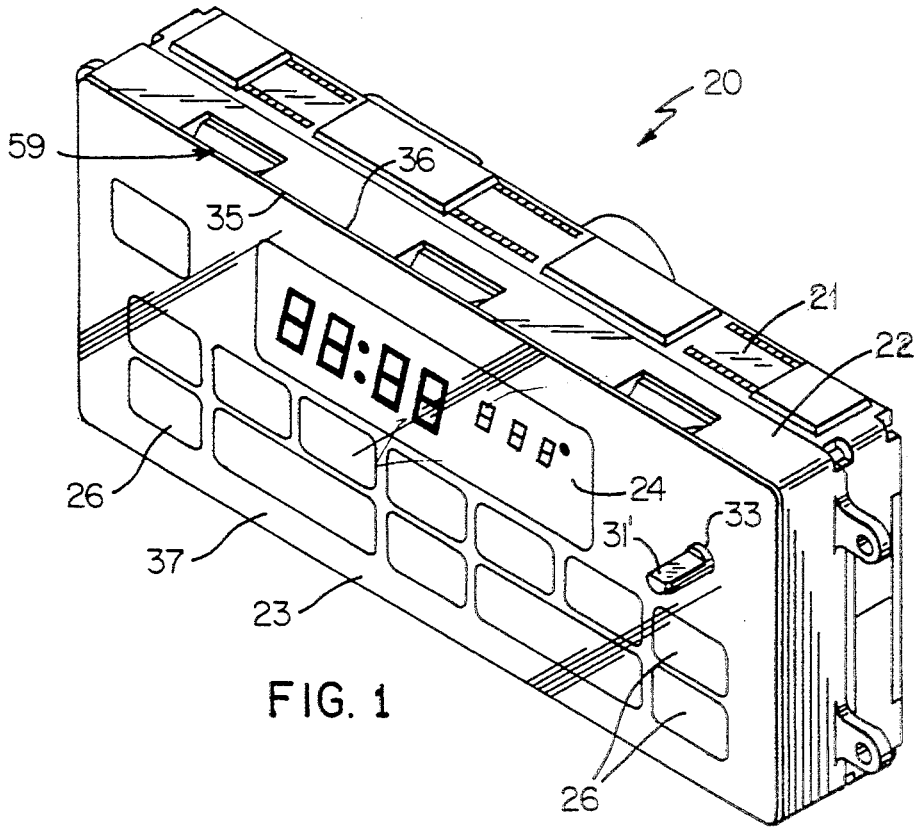
FIG. 1 is a perspective view of the new control device of this invention.

While the various features of this invention are hereinafter illustrated and described as being particularly adapted to provide a control device for a cooking apparatus, it is to be understood that the various features of this invention can be utilized singly or in various combinations thereof to provide a control device for other apparatus desired.

Therefore, this invention is not to be limited to only the embodiment illustrated in the drawings, because the drawings are merely utilized to illustrate one of the wide variety of uses of this invention.

Figure 2:
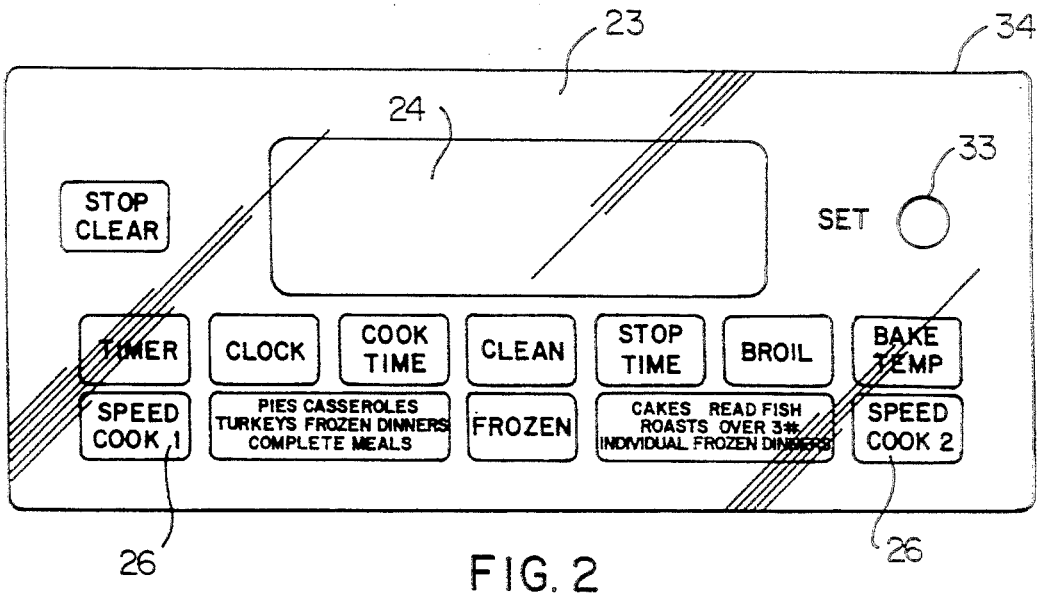
FIG. 2 is an enlarged front view of the cover member that forms part of the control device of FIG. 1.
Figure 3:
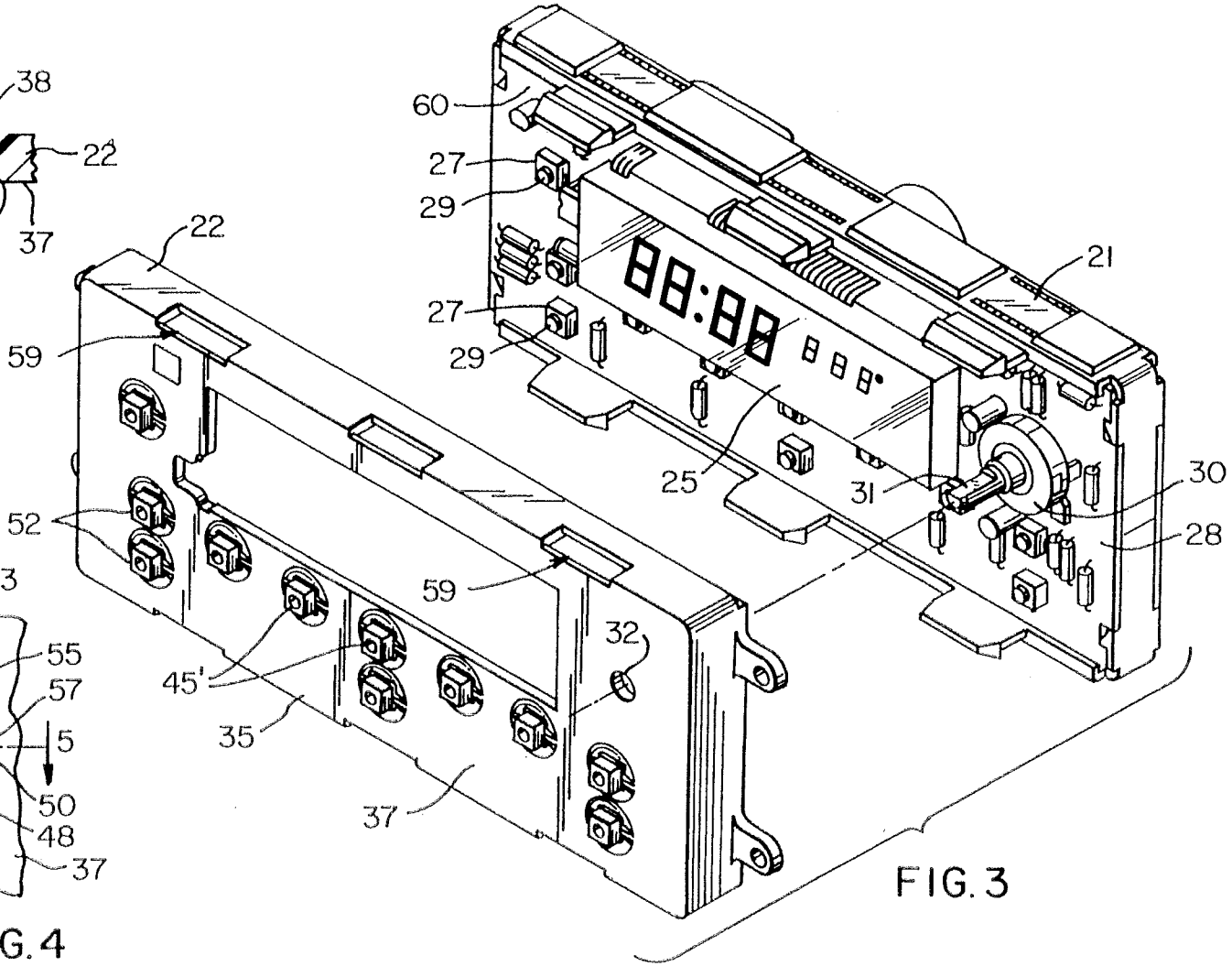
FIG. 3 is an exploded perspective view of the support means and the bracket means that form the control device of FIG. 1 along with the cover member of FIG. 2.

Referring now to FIG. 1, the new control device of this invention is generally indicated by the reference numeral 20 and, in general, comprises a support means or member 21, a bracket means or member 22 carried by the support means 21 and a cover means or member 23 carried on the front of the bracket means 22 to present a window area 24 through which data on a vacuum fluorescent display 25, FIG. 3, can be viewed and to provide a plurality of finger depressable areas 26 for selecting various functions that the control device 20 is to control as indicated by suitable wording on such areas 26 in the manner illustrated in FIG. 2.

Each depressable area 26 of the cover means 23 controls the operation of an electrical switch means 27, FIG. 3, carried on a printed circuit board means 28 that forms part of the support means 21 in a manner well known in the art and having a movable actuator means 29 that is normally biased outwardly by suitable spring means (not shown) in the switch unit 27 so as to maintain that switch unit 27 in one operating condition, such as being open. However, when the actuator means 29 of a switch unit 27 is pushed axially inwardly to a certain position, the switch means 27 is changed to another operating condition thereof, such as being closed, all in a manner well known in the art. For example, see the U.S. patent to Kadwell et al, U.S. Pat. No. 4,782,515 whereby this U.S. patent is being incorporated into this disclosure by this reference thereto.

The support means 21 of the control device 20 of this invention can also carry a rotary switch means 30 on the circuit board means 28, the rotary switch means 30 having a rotatable shaft 31 extending outwardly therefrom and respectively passing through an aligned opening means 32 in the bracket means 22 and an aligned opening means 33 passing through the cover means 23 to have a suitable control knob (not shown) interconnected on an outer end 31' thereof in order to permit the operator to rotate the shaft 31 and thereby enter data into the control device 20 all in a manner well known in the art., For example, see the U.S. patent to Fowler et al, U.S. Pat. No. 4,625,084 whereby this U.S. patent is also being incorporated into this disclosure by this reference thereto.

Therefore, since the reason for and the manner of operating an electronic control device that has a plurality of switch means 27 and a rotary switch 30 for controlling various functions of a cooking apparatus are well known in the art, a further discussion of such operating features of the control device 20 of this invention is deemed unnecessary as the unique features of this invention are directed to the structure of and the manner of operating switch means 27 as well as to the method of making the same and the control device 20 which will now be described.

The cover means 23 of this invention comprises a relatively thin and flexible flat plastic sheet that has an outer rectangularly shaped peripheral surface means 34 that is adapted to be secured to an outer rectangular surface means 35 of the bracket means 22 in any suitable manner, such as by adhesive means disposed on the rear surface 36 of the cover member 23 and only on the outer peripheral area 34 thereof so that the medial area of the cover means 23 will remain relatively flexible for a purpose hereinafter set forth.

Figure 13:
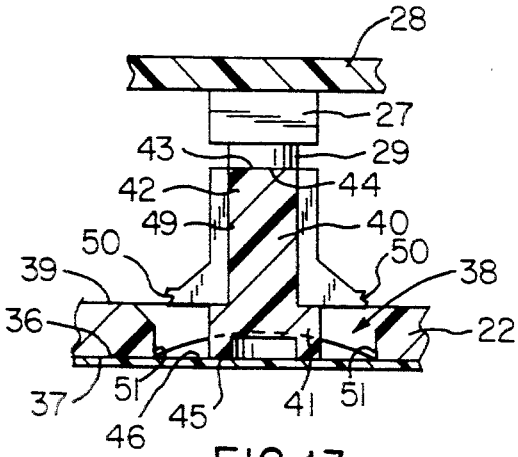
FIG. 13 is an enlarged fragmentary cross-sectional view illustrating one of the plunger means for one of the switch units being disposed in one operating condition thereof.

The bracket member 22 has a substantially flat front wall surface 37 against which the cover member 23 is secured so that the depressable areas 26 of the cover member 23 are normally disposed in a flat coplanar relationship throughout the cover member 23 in the manner illustrated in FIG. 13.

The bracket means 22 can be formed of any suitable material, such as plastic material, and has been uniquely molded in a manner hereinafter described to have a plurality of opening means 38 passing completely through opposed sides 37 and 39 thereof and being adapted to be respectively aligned with the actuator means 29 of the switch means 27 carried on the circuit board 28 of the support means 21 when the bracket means is secured to the support means 21.

A plurality of plunger means 40 respectively have first parts 41 thereof respectively disposed in the opening means 38 of the bracket means 22 and second parts 42 thereof respectively being engagable with the actuator means 29 of the switch means 27 in the manner illustrated in FIG. 13, each plunger means 40 having an end surface 43 thereof engaging against the end 44 of its respective plunger 29 while having an outer surface 45 of the first 41 thereof engaging against the inside surface 46 of its respective depressable area 23 of the cover member 23 whereby it can be seen in FIG. 13 that as long as the depressable area 26 is disposed in its non-depressed condition, the actuator means 29 for that depressable area 26 is permitted to remain in its out condition by the force of the spring means in the switch means 27 so that the switch means 27 can be in one operating condition thereof, such as an open condition thereof. While FIG. 13 illustrates the plunger means 40 being in actual engagement with the plunger 29, it is to be understood that there could be a slight gap between the surfaces 43 and 44 if desired under this condition of the depressable area 26 of the cover member 23 therefor.

Figure 14:
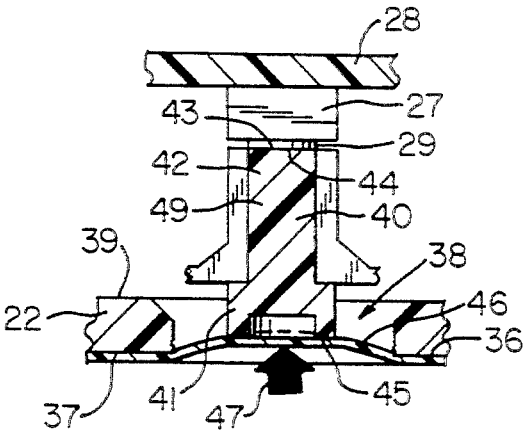
FIG. 14 is a view simular to FIG. 13 and illustrates the plunger means in another operating position thereof.

In any event, when the depressable area 26 of FIG. 13 is depressed inwardly as indicated by the arrow 47 in FIG. 14, such as by an operator pushing his finger on the depressable area 26 and moving the same toward the support means 21, the plunger means 40 moves axially inwardly and carries the actuator means 29 of the switch means 27 therewith whereby the switch means 27 can be operated to the other operating condition thereof, such as being a closed condition of the switch means 27 which through the printed circuit (not shown) on the printed circuit board 28 completes an electrical path for the control device 20 to cause the control device 20 to be operated in a manner well known in the art.

After the switch means 27 has been actuated in the manner illustrated in FIG. 14 and the operator removes his finger from the depressable area 26, the depressable area 26 rebounds out to its natural out condition as illustrated in FIG. 13 and the force of the spring means in the switch unit 27 moves its plunger 29 outwardly and carries the plunger 40 therewith to return to the condition illustrated in FIG. 13 whereby the switch means 27 is returned to its other operating condition, such as being open.

Therefore, it can be seen that each plunger means 40 of this invention will operate its respective switch means 27 in the manner previously described under the control of its respective depressable area 26 of the control device 20 in an effective and efficient manner, each such plunger means 40 being so arranged that the same floats between its operating positions with its first part 41 always having at least a portion thereof disposed in its respective opening means 38 of the bracket means 22 to be guided in its axially movement relative to the support means 21 and be maintained in its axially alignment with its respective plunger means 29.

From the above, it can be seen that to assemble the plunger means 40 within the plurality of opening means 38 during the making of the control device 20 would be highly labor intensive and require a separate inventory of the plunger means 40 from the bracket means 22.

However, as previously stated, one of the features of this invention is to uniquely form the plunger means 40 with the bracket means 22 so that the same are integral and one-piece therewith whereby the bracket means 22 can be assembled to the support means 21 while the plunger means 40 are integral and one-piece therewith and thereafter the plungers 40 can be separated from the bracket means 22 and be held in the operating positions thereof when the cover means 23 is assembled to the bracket means 22 whereby such an arrangement eliminates the manual placement of the plunger means 40 in the opening means 38 of the bracket means 22 as well as eliminates a separate inventory of the plunger means 40 and the problems associated therewith.

Figure 5:
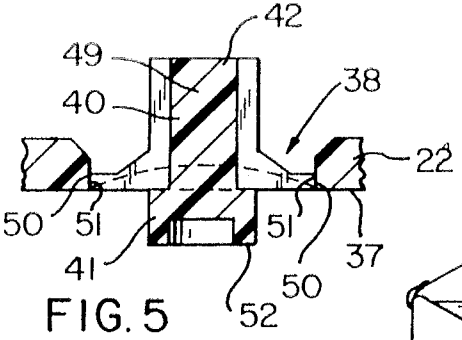
FIG. 5 is a fragmentary cross-sectional view taken on line 5—5 of FIG. 4.
Figure 6:
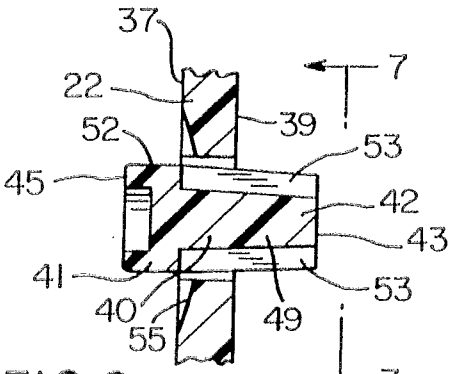
FIG. 6 is a fragmentary cross-sectional view taken on line 6—6 of FIG. 4.

In particular, it can be seen that the bracket means 22 is initially so molded that each plunger means 40 has a pair of like projections 48 extending outwardly from opposite sides of a stem portion 49 thereof and respectively being provided with edge means 50 that are integral and one-piece with edge means 51 of the bracket means 22 whereby the projections 48 span the respective opening 38 in the bracket means 22 and hold the plunger means 40 with the first part 41 thereof that comprises an enlarged substantially squared shaped head 52 with its end surface 45 beyond the front surface 37 of the bracket means 22 as illustrated in FIGS. 5 and 6.

Figure 7:
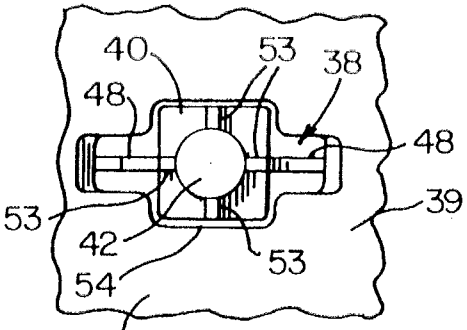
FIG. 7 is a rear view of the structure illustrated in FIG. 6 and is taken in the direction of the arrows 7—7 of FIG. 6.

The stem 49 of each plunger means 40 has a generally circular transversed cross-sectional configuration as illustrated in FIG. 7 and has four fins or ribs 53 extending longitudionally along the same with two of the fins 53 merging with the projections 48 as illustrated in FIG. 5 whereby the fins 53 join with the enlarged head 52 of the respective plunger means 40 as illustrated in FIGS. 5 and 6.

Figure 4:
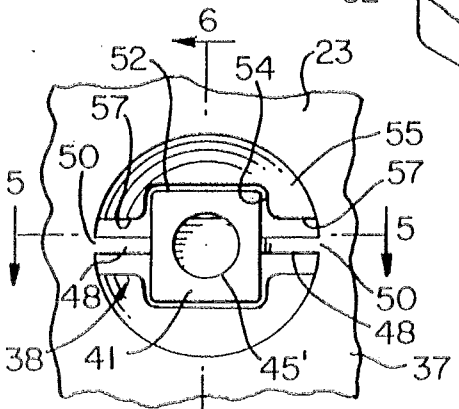
FIG. 4 is an enlarged fragmentary front view of one of the plunger means of the bracket means of FIG. 3.

As illustrated in the drawings, each opening means 38 through the bracket means 22 defines a portion 54 that has a substantially square cross-sectional configuration and a dome shaped portion 55 that interrupts the surface 37 of the bracket means 22 to define a dish-shaped area that is substantially circular at the outer peripheral edge means 56 thereof and joins with the square shaped portion 54 as illustrated, each opening 38 also defining two opposed sections 57 that join with the square shaped portion 54 and in which the integral projections 48 of the respective plunger means 40 are located as illustrated in FIGS. 4 and 5.

Figure 8:
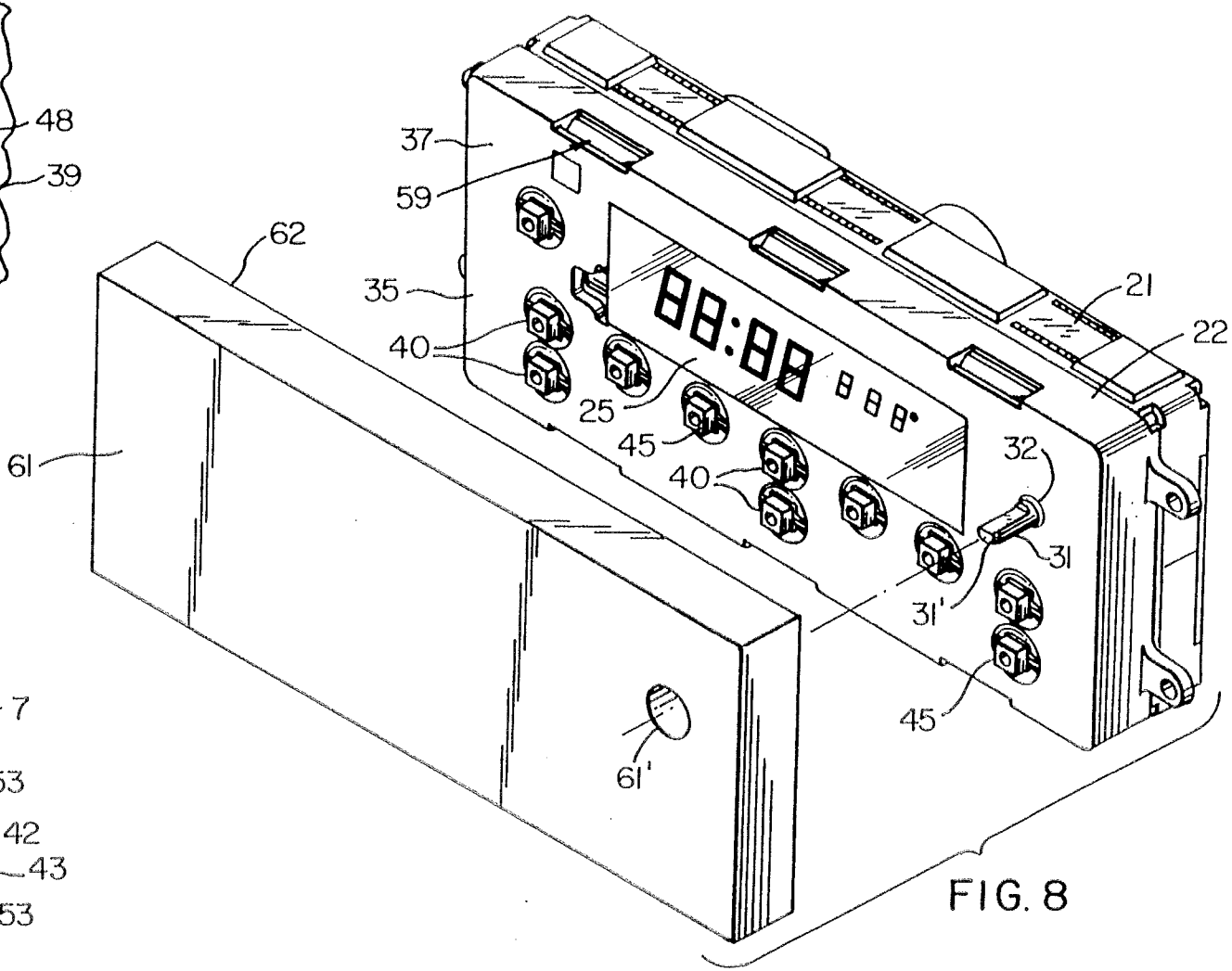
FIG. 8 is an exploded perspective view of the parts of the control device illustrated in FIG. 3 having been assembled together together with a means for breaking loose the plunger means of the bracket means of the structure of FIG. 8.
Figure 10:
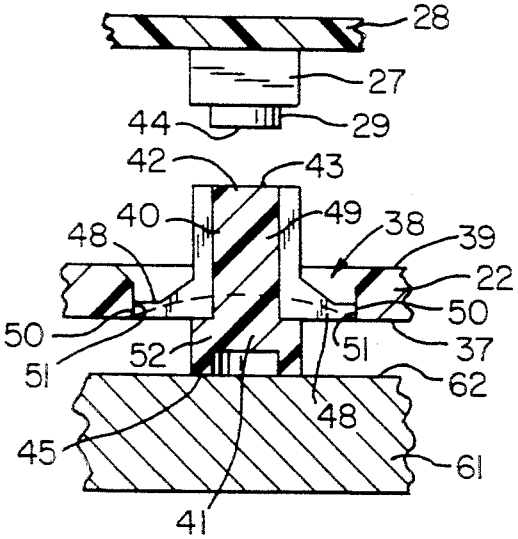
FIG. 10 is a fragmentary cross-sectional view illustrating how the plate member of FIGS. 8 and 9 initially engages one of the plunger means of the bracket means.

While the bracket means 22 can be interconnected to the support means 21 in any suitable manner, the embodiment thereof illustrated in the drawings comprises a snap-fit arrangement wherein a plurality of outwardly directed tongues 58 of the support means 21 are adapted to be respectively received in cooperating slots 59 of the bracket means 22 when the bracket means 22 is assembled against the front surface 60 of the support means 21 in the manner illustrated in FIG. 8 so that the bracket means 22 is carried by the support means 21 as illustrated in FIG. 8, such arrangement being illustrated in FIG. 10 wherein it can be seen that each plunger means 40 that is carried by the bracket means 22 has the end surface 43 thereof substantially spaced from the end surface 44 of the respective actuator means 29 of the respective switch means 27 as illustrated.

Thereafter, the plunger means 40 are adapted to be separated from the bracket means 22 in any suitable manner wherein the edge means 50 of the projections 48 thereof are completely severed from the edge means 51 of the bracket means 22.

For example, such edge means 50 of the projections 48 could be die cut from the bracket means 22 or the same could be physically broken away from the same in the manner illustrated in the drawings.

Figure 9:
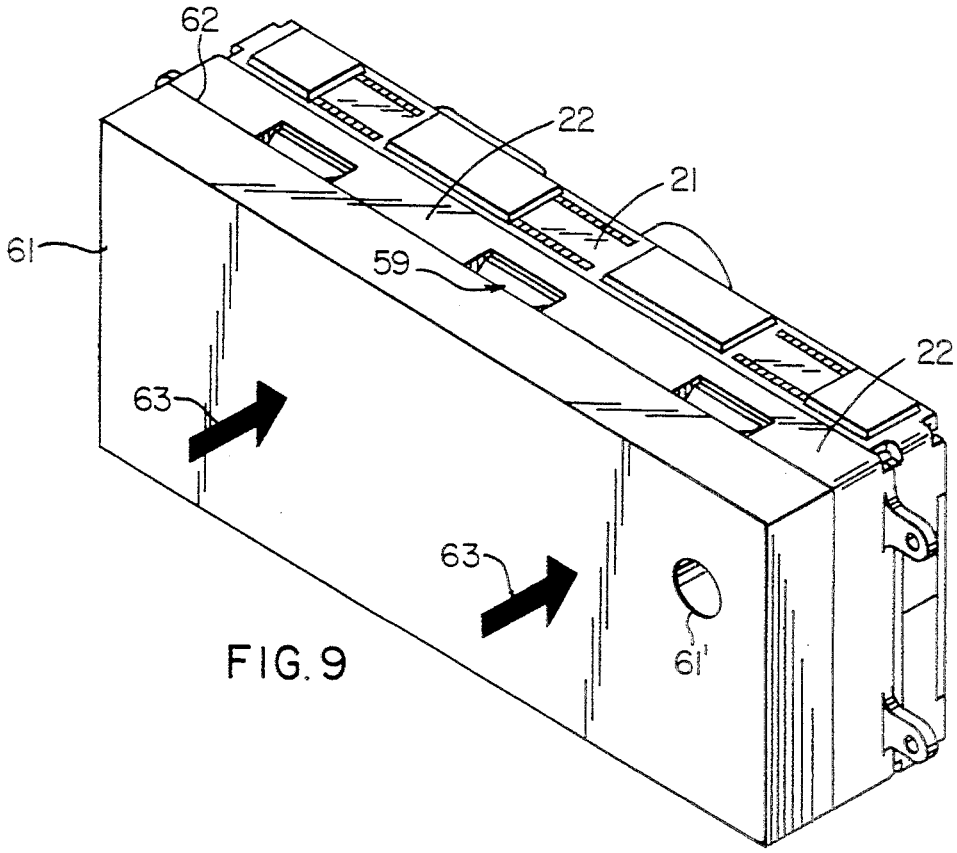
FIG. 9 is a view simular to FIG. 8 and illustrates the plate member in a position wherein the plunger means have been broken loose.
Figure 11:
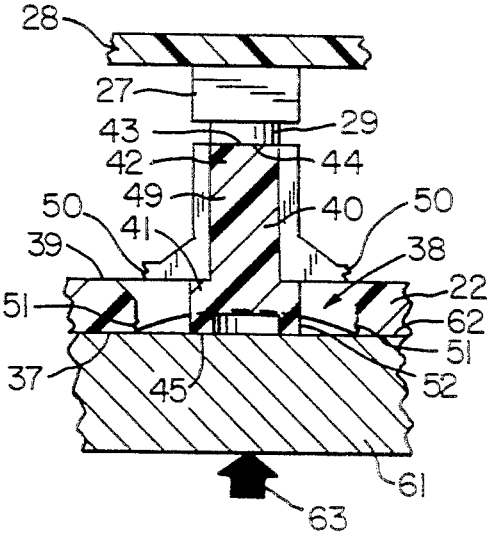
FIG. 11 is a view simular to FIG. 10 and illustrates how the plate means of FIG. 10 has been moved to break loose the engaged plunger means.

In particular, a substantially flat plate 61 can have a flat side 62 thereof moved substantially simultaneously against the ends 45 of the plunger means 40 in the manner illustrated in FIGS. 9 and 10 to completely break loose or shear the edge means 50 of the projections 48 of the plunger means 40 from the respective edge means 50 of the bracket means 22 in the manner illustrated in FIG. 11 as the plate 61 is moved toward the surface 37 of the bracket means 22 as indicated by the arrows 63 in FIGS. 9 and 11, the plate 61 having an opening 61' therethrough to receive the shaft 31 for this purpose.

Figure 12:
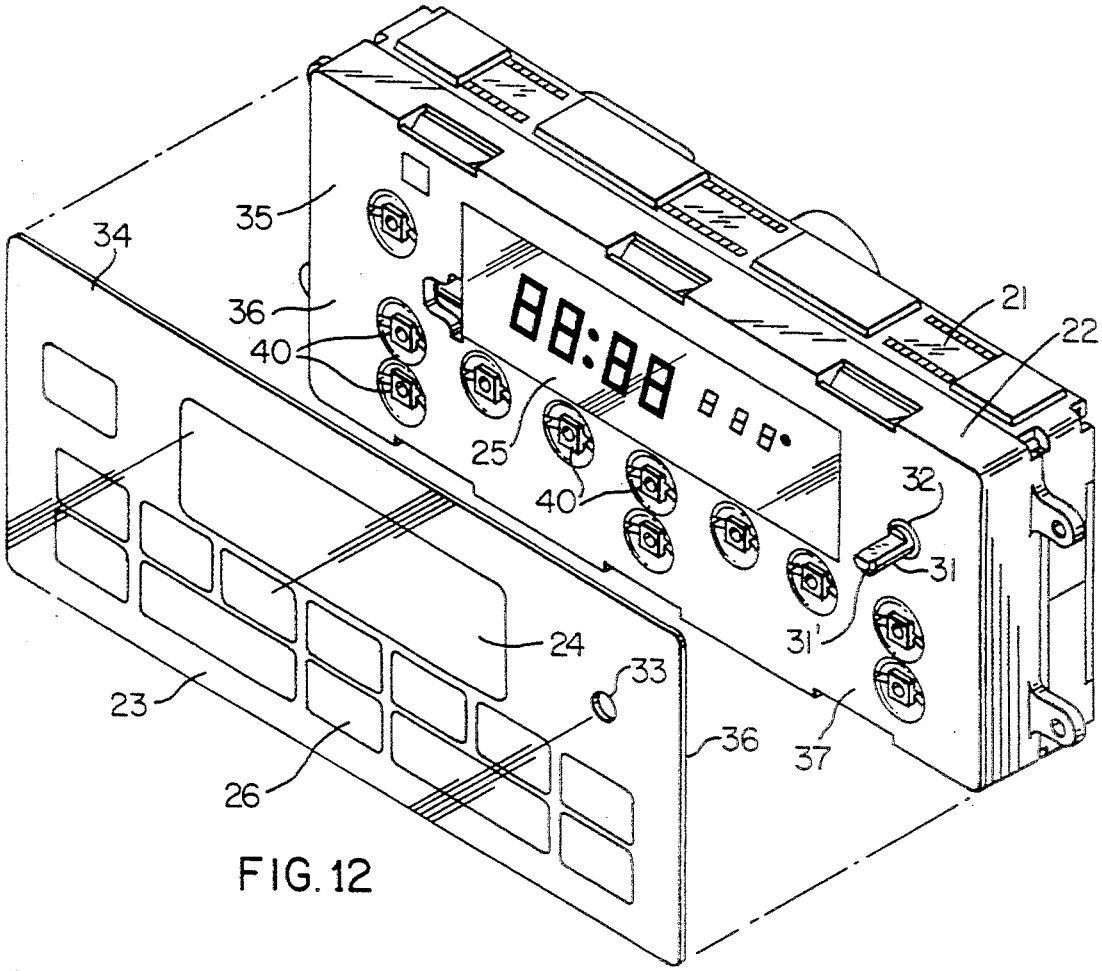
FIG. 12 is an exploded perspective view illustrating the structure of FIG. 8 of the control device after the plunger means have been broken loose and before the cover member is secured thereto.

While FIGS. 10 and 11 illustrate a vertical arrangement of the plate 62 with the bracket 22, it is to be understood that the control device 20 would be disposed in a suitable fixture with the surface 37 of the bracket means 22 facing vertically upwardly and the plate 61 would be moved vertically downwardly to break loose the plunger means 40 therefrom, the plate 61 either moving all the way against the surface 37 or terminating short of the same as the complete movement illustrated in FIGS. 10 and 11 is not necessary to break loose the cooperating edges 50 and 51 as desired. Thereafter, the plate 61 would be backed off of the bracket means 22 and the cover member 34 would then be secured in place in the manner illustrated in FIG. 12, such cover member 23 being assembled to the control device 20 while the surface 37 of the bracket means 22 is facing vertically upwardly whereby there will be no falling out of the broken away plunger means 40 from their respective openings 38 before the cover member 23 is secured in place.

Once the cover member 23 has been secured in place in the manner previously set forth, it can readily be seen from FIGS. 13 and 14 that the plunger means 40 are completely trapped between the cover member 23 and the actuators 29 of the switch means 27 so as to be guided in their movement between the respective operating positions thereof by the opening means 38 of the bracket means 22.

It can also be seen from FIGS. 13 and 14 that during the movement of each plunger means 40 between any of the operating positions thereof, the now ragged or broken away edges 50 of the plungers 40 will never again engage against the now broken away or ragged edges 50 of the bracket means 22 as the surfaces 45 of the plungers 40 are now disposed substantially coplaner with the surface 37 of the bracket means 22 when the plungers 40 are in their out condition as illustrated in FIG. 13.

If desired, the surfaces 45 of the plunger means 40 can each be interrupted by a circular recess 45' as illustrated in the drawings.

Therefore, it can be seen that it is a relatively simple method of this invention to initially form the plunger means 40 as integral parts of the bracket means 22 so as to be integral and one-piece therewith and when it is desired to assemble a control device 20, the bracket means 22 can be fastened to the support means 21 in the manner previously described and then any suitable means can be utilized to break loose the plungers 40 from the bracket means 22 in a manner to prevent the plungers 40 from falling out of the openings 38 and thereafter the cover member 23 can be secured in place to trap the broaden away plungers 40 between the cover means 23 and the actuators 29 of the switch means 27 in the manner previously described whereby the plungers 40 now float in the openings 38 of the bracket means 22 as the same are completely separated therefrom and are movable between the operating positions thereof in the manner previously described to operate the switch means 27 when desired.

Thus, it can be seen that this invention not only provides a new control device, but also this invention provides a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a support means, a plurality of electrical switch means carried by said support means and each having a movable actuator means, a bracket means carried by said support means and having a plurality of opening means passing therethrough and being respectively aligned with said actuator means, a cover means carried by said bracket means and having a plurality of finger movable areas respectively covering said opening means, and a plurality of plunger means having first parts thereof respectively disposed in said opening means and having second parts thereof being engagable with said actuator means, the improvement wherein each said plunger means was initially integral and one-piece with said bracket means and has been separated therefrom to freely float relative to said bracket means between its respective movable area of said cover means and its respective actuator means whereby each movable area of said cover means is finger depressed toward said support means to move its respective plunger means and thus its respective actuator means to change the operating condition of its respective switch means.

2. A control device as set forth in claim 1 wherein said bracket means has opposed surface means through which said opening means extended, each said plunger means initially having said first part thereof extending beyond one of said opposed surface means of said bracket means that faces away from said support means before each of said plunger means is separated from said bracket means.

3. A control device as set forth in claim 2 wherein each said plunger means has a separated edge means thereof that initially was interconnected to said bracket means and is now disposed beyond the other of said surface means of said bracket means in all operating positions of each of said plunger means.

4. A control device as set forth in claim 3 wherein said bracket means has edge means disposed in each said opening means thereof that initially were respectively interconnected to said edge means of said plunger means whereby said edge means of said bracket means are never engaged by said edge means of said plunger means in any operating position of said plunger means.

5. A control device as set forth in claim 4 wherein each edge means comprises two edges disposed approximately 180° apart.

6. A control device as set forth in claim 4 wherein each said plunger means comprises a stem having opposed ends and an enlarged head carried at one of said ends of said stem, said head of each said plunger means comprising said first part thereof.

7. A control device as set forth in claim 6 wherein the other of said ends of said stem of each of said plunger means comprises said second part thereof.

8. A control device as set forth in claim 7 wherein said head of each said plunger means has a rectangular configuration and each said opening means has a cooperating rectangularly shaped portion receiving its respective said head therein.

9. A control device as set forth in claim 2 wherein each said opening means in said bracket means defines a recess in said one of said opposed surface means of said bracket means.

10. A control device as set forth in claim 9 wherein each said recess means has a dish-shape.

11. In a method of making a control device comprising a support means, a plurality of electrical switch means carried by said support means and each having a movable actuator means, a bracket means carried by said support means and having a plurality of opening means passing therethrough and being respectively aligned with said actuator means, a cover means carried by said bracket means and having a plurality of finger movable areas respectively covering said opening means, and a plurality of plunger means having first parts thereof respectively disposed in said opening means and having second parts thereof being engagable with said actuator means, the improvement comprising the steps of forming each said plunger means to be initially integral and one-piece with said bracket means, and then separating said plunger means from said bracket means so that said separated plunger means freely float relative to said bracket means between its respective movable area of said cover means and its respective actuator means whereby each movable area of said cover means is finger depressed toward said support means to move its respective plunger means and thus its respective actuator means to change the operating condition of its respective switch means.

12. A method as set forth in claim 11 and comprising the steps of forming said bracket means to have opposed surface means through which said opening means extend, and forming each said plunger means to initially have said first part thereof extending beyond one of said opposed surface means of said bracket means that faces away from said support means before each of said plunger means is separated from said bracket means.

13. A method as set forth in claim 12 and comprising the step of forming each said plunger means to have a separated edge means thereof that initially was interconnected to said bracket means and is now disposed beyond the other of said surface means that faces of said bracket means in all operating positions of each of plunger means.

14. A method as set forth in claim 13 and comprising the step of forming said bracket means to have edge means disposed in each said opening means thereof that initially were respectively interconnected to said edge means of said plunger means whereby said edge means of said bracket means are never engaged by said edge means of said plunger means in any operating position of said plunger means.

15. A method as set forth in claim 14 and comprising the step of forming each edge means to comprise two edges disposed approximately 180° apart.

16. A method as set forth in claim 14 and comprising the steps of forming each said plunger means to comprise a stem having opposed ends and an enlarged head carried at one of said ends of said stem, and forming said head of each said plunger means to comprise said first part thereof.

17. A method as set forth in claim 16 and comprising the step of forming the other of said ends of said stem of each of said plunger means to comprise said second part thereof.

18. A method as set forth in claim 17 and comprising the steps of forming said head of each said plunger means to have a rectangular configuration, and forming each said opening means to have a cooperating rectangularly shaped portion receiving its respective said head therein.

19. A method as set forth in claim 12 and comprising the step of forming each said opening means in said bracket means to define a recess in said one of said opposed surface means of said bracket means.

20. A method as set forth in claim 19 and comprising the step of forming each said recess means to have a dish-shape.

21. A method as set forth in claim 11 wherein said bracket means is secured to said support means before said plunger means are separated from said bracket means.

22. A method as set forth in claim 21 wherein said cover means is secured to said bracket means after said plunger means have been separated from said bracket means.

* * * * *